US006155649A

United States Patent [19]

Sessler, Jr. et al.

[11] Patent Number: 6,155,649

[45] Date of Patent: Dec. 5, 2000

[54] PROCESS FOR DEMOLISHING A BRIDGE STRUCTURE

[75] Inventors: LaVerne M. Sessler, Jr.; Craig L. Sessler, both of Geneva, N.Y.

[73] Assignee: L. M. Sessler Excavating and Wrecking, Inc., Waterloo, N.Y.

[21] Appl. No.: 09/326,842

[22] Filed: Jun. 7, 1999

[51] Int. Cl.[7] ..... E21C 37/00

[52] U.S. Cl. ..... 299/10; 299/18; 29/897.1; 296/36; 414/397

[58] Field of Search ..... 299/10, 18; 14/77.1, 14/78; 52/DIG. 12; 29/897.1; 296/26.01, 26.06, 32, 36, 100.1, 100.06; 414/328, 373–389, 397, 809, 787

[56] References Cited

U.S. PATENT DOCUMENTS 3,995,890 12/1976 Fletcher ..... 296/100.1 X
4,955,972 9/1990 LaBounty ..... 294/68.26
5,653,508 8/1997 Carney ..... 299/18 X

*Primary Examiner*—Eileen D. Lillis
*Assistant Examiner*—Sunil Singh
*Attorney, Agent, or Firm*—Howard J. Greenwald

[57] ABSTRACT

A process for demolishing a bridge deck by a truck assembly equipped with a a receptacle comprised of a right side and a left side and a first wing rotatably connected to the right side of the receptacle. The process includes the steps of: (a) disposing the truck assembly beneath the bridge deck, (b) rotating the first wing upwardly and outwardly from the right side of the receptacle to a first position, (c) supporting the first wing in its first position by a support contiguous with the first wing, (d) demolishing the bridge deck and causing debris to fall therefrom, (d) receiving debris from the bridge deck within the receptacle, (e) ceasing supporting the first wing in its first position and moving it downwardly and inwardly towards the right side of the receptacle, (f) moving the truck assembly, and (g) removing debris from the receptacle.

16 Claims, 4 Drawing Sheets

FIG. 4
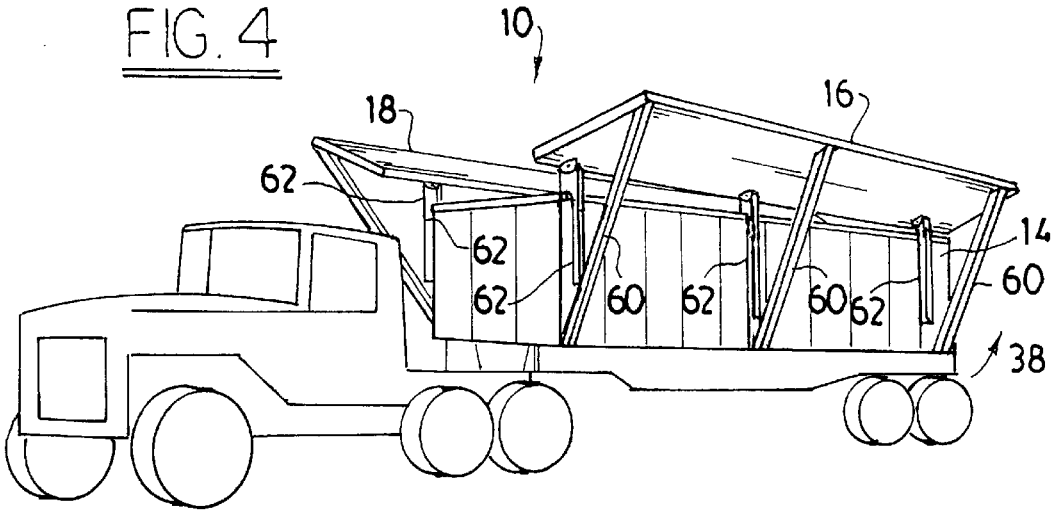
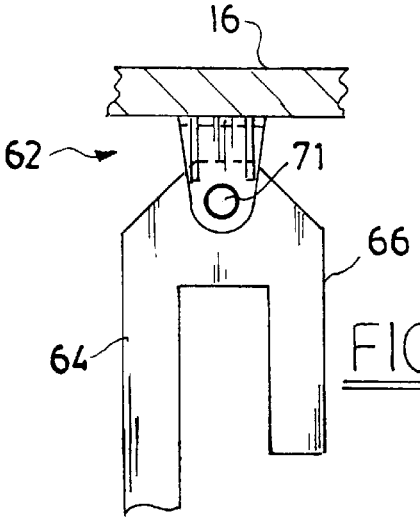
FIG. 5
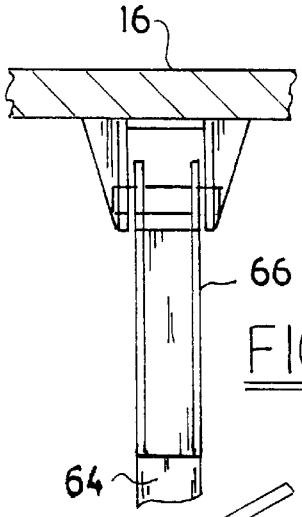
FIG. 6
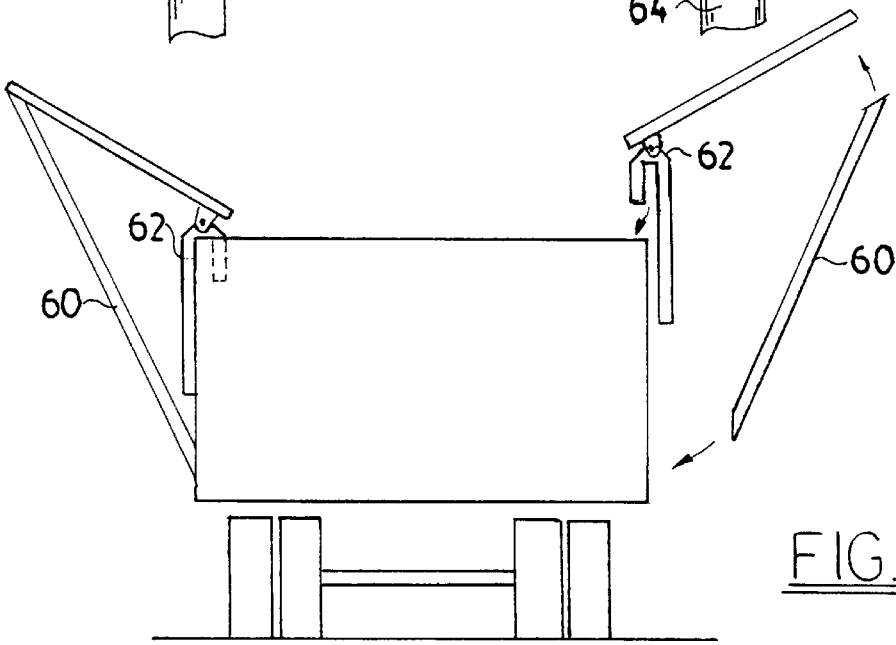
FIG. 7

PROCESS FOR DEMOLISHING A BRIDGE STRUCTURE

FIELD OF THE INVENTION

A process for demolishing a bridge structure in which a truck with a receptacle and a movable wing connected to the receptacle is disposed under a bridge structure and the bridge structure is thereafter demolished.

BACKGROUND OF THE INVENTION

U.S. Pat. No. 4,955,972 of Roy E. LaBounty discloses a container for catching falling debris from bridge deck demolitions. In the process described in this patent, a crane is disposed near a bridge deck and suspends a receptacle by means of a support arm connected to the receptacle. Thereafter, by means of a cable connected to the receptacle and the crane, the receptacle is tilted so that crushed, collected concrete slides off of an open end of the receptacle and into a dump truck.

This process is rather cumbersome and complicated, requiring a crane, a multiplicity of cables, a receptacle, and a dump truck. Furthermore, because of the manner in which the receptacle is supported by the crane and tilted by the crane, the receptacle can only be placed under a portion of the bridge; the device of this patent effectively only can work at the edges of the bridge deck and, after they are demolished, at the new edges so formed; it is not capable of working in the middle of the bridge deck. Thus, multiple cycles involving the steps of placing the receptacle at a specified location, filling the receptacle, moving and unloading the receptacle, moving the crane, repositioning the receptacle, and refilling it, are required.

It is an object of this invention to provide a process for demolishing a bridge structure in which a receptacle for receiving debris from the demolished bridge structure may be located underneath the bridge structure.

SUMMARY OF THE INVENTION

In accordance with this invention, there is provided a process for demolishing a bridge deck. In the first step of this process, a truck with a receptacle and a movable wing connected to the receptacle is disposed beneath a first portion of a bridge deck so that a substantial portion of the width of the bridge deck is disposed over the receptacle. Thereafter, the movable wing is raised towards the bottom of the bridge deck, the bridge deck is demolished, debris from the bridge deck is received in the receptacle, and the truck is moved away from the first portion of the bridge deck.

BRIEF DESCRIPTION OF THE DRAWINGS

The claimed invention will be described by reference to the specification and to the enclosed drawings, in which like numerals refer to like elements, and in which:

FIG. 4 is a perspective view of another preferred truck with a dump trailer which can be used in the process of this invention;

FIG. 5 is a front view of a connector which may be used to connect one or more wings to the dump trailer depicted in FIG. 4;

FIG. 6 is a side view of the connector of FIG. 5;

FIG. 7 is a schematic illustration of one preferred means for supporting the wings of the truck of FIG. 4;

DESCRIPTION OF THE PREFERRED EMBODIMENTS

Figure 1:
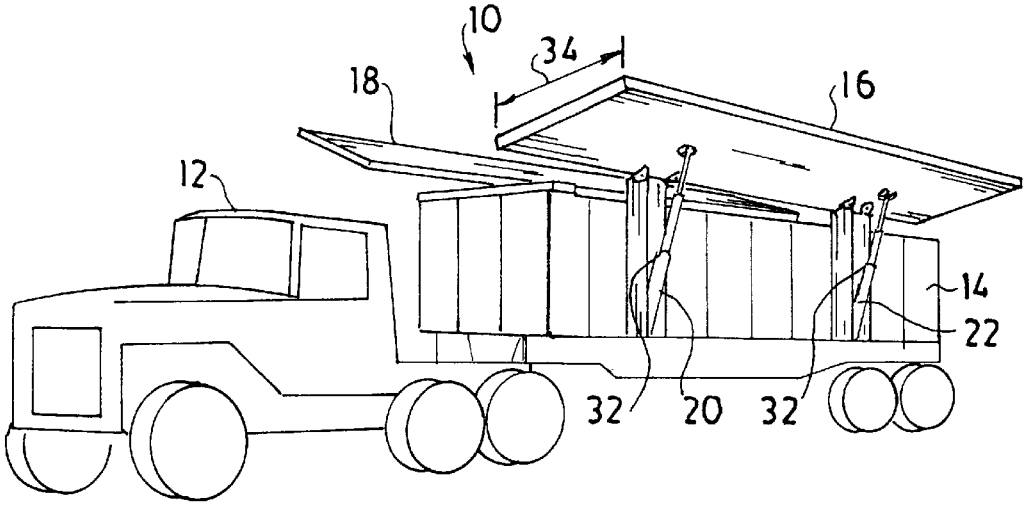
FIG. 1 is a perspective view of one preferred truck with a dump trailer which can be used in the process of this invention.

FIG. 1 illustrates a preferred winged tractor trailer 10 which may be used in the process of the invention. Referring to FIG. 1, it will be seen that winged tractor trailer 10 is comprised of a truck 12 attached by conventional means to a rear dump trailer 14. As is known to those skilled in the art, a rear dump trailer is a receptacle with means for removably connecting the trailer to a tractor (such as a truck), a multiplicity of wheels attached to the trailer, and means for removing debris contained in the dump trailer by tilting the trailer up and away from the trailer bed at an angle greater than about 30 degrees and removing the debris from the rear of the trailer. These and similar dump trailers are well known to those skilled in the art and are described, e.g., in U.S. Pat. Nos. 5,782,538 (end dump trailer), 5,681,095 (dump body for a vehicle), 5,662,374 (dump body), 5,482,356 (rear dump trailer), 4,968,096 (dump trailer with lifting mechanism), 4,659,147 (dump trailer), 4,616,879, and the like. The entire description of each of these United States patents is hereby incorporated by reference into this specification.

In one embodiment, not shown, a dump truck is used instead of the dump trailer assembly 14. Such dump trucks are well known to those skilled in the art and are described, e.g., in U.S. Pat. Nos. 5,588,712, 5,452,942, 5,407,251, 4,955,972, 3,881,764, 3,601,447, and the like. The disclosure of each of these United States patents is hereby incorporated by reference into this specification.

Figure 3:
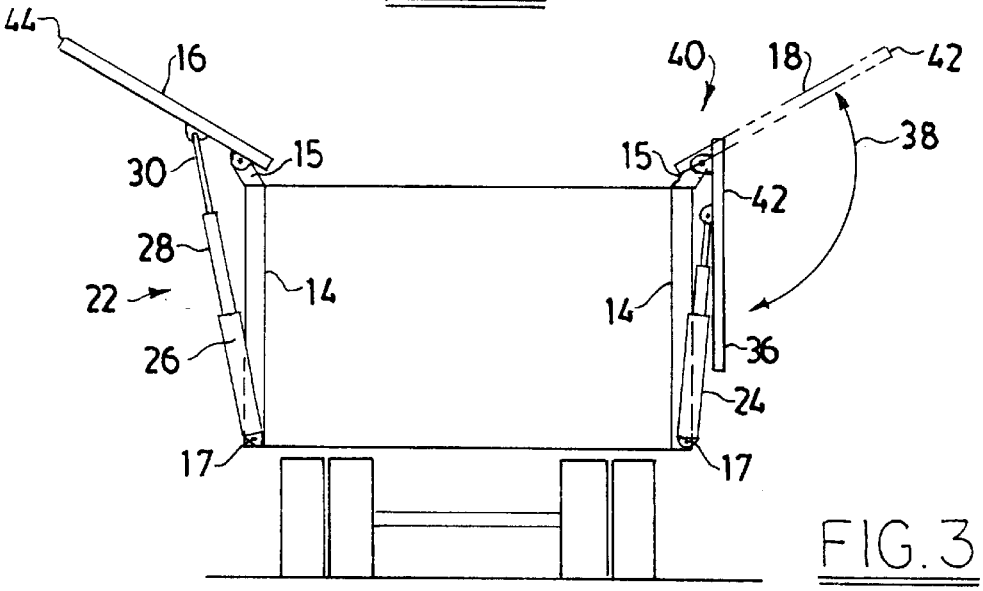
FIG. 3 is a back view of the truck of FIG. 1
Figure 8:
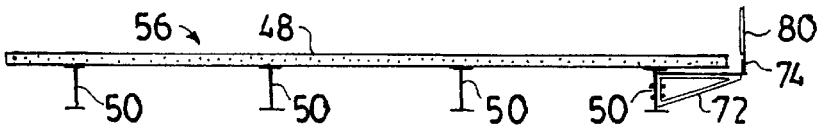
FIG. 8 is sectional view of a bridge structure to which is connected an overhang bracket assembly.

FIG. 3 illustrates wing 18 in its initial position 36. After it is raised by means of two-stage hydraulic cylinder 24, it will be seen that wing 18 will have moved upwardly and outwardly in the direction of arrow 38 to the position 40 depicted in dotted line outline in FIG. 3. The angle 42 between the initial position 36 of wing 18 and its final position 40 is generally from about 10 to about 180 degrees. It is generally preferred that angle 42 be from about 60 to about 150 degrees and, even more preferably, from about 100 to about 150 degrees. It one preferred embodiment, the top surfaces, 42 and 44, of wings 18 and 16 actually touch the bottom 46 of the bridge structure being worked on.

Referring again to FIG. 3, it will be seen that wings 16 and 18 are preferably rotatably attached to trailer 14 by means of bracket 15, which is preferably integrally joined to trailer 14 by conventional means, such as welding. The bracket 15 is also connected to the wings 16 and 18 by conventional fasteners, such as, e.g., a solid pin. The two-stage hydraulic cylinder assemblies 24 and 22 are attached to trailer 14 by means of, e.g., brackets 17, each of which also is preferably integrally connected to trailer 14 by welding.

Figure 2:
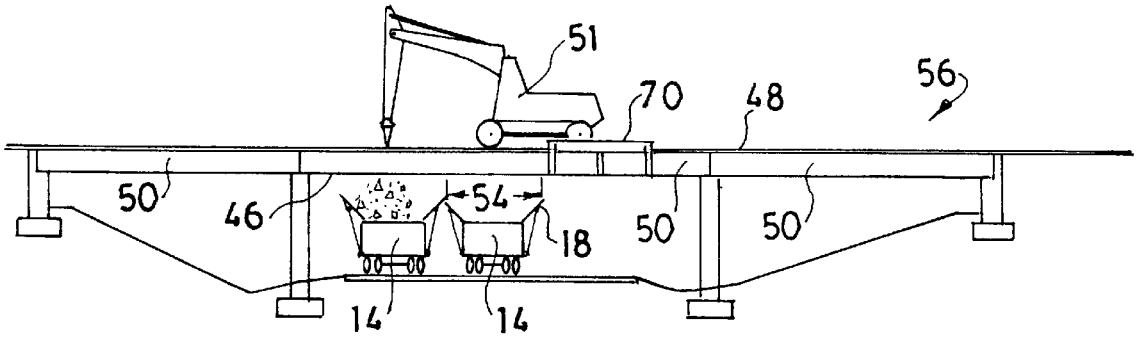
FIG. 2 is a schematic view illustrating how two of the trucks of FIG. 1 may be used in the process of the invention.

FIG. 2 illustrates one aspect of applicants' claimed process. In this embodiment, a bridge deck 48 is being demolished. As is known to those skilled in the art, a bridge deck is the surface of the bridge upon which vehicular traffic rides and can be comprised of or consist of concrete, steel, wood, etc. In one preferred embodiment, the bridge deck 48 consists essentially of reinforced concrete supported by steel girders 50.

Reinforced concrete bridge decks are well known to those skilled in the art and are described, e.g., in U.S. Pat. Nos. 5.579,361, 5,664,378, 5,639,358, 5,595,034, 5,509,243, 5,449,563, 5,427,819, and the like. The entire disclosure of each of these United States patents is hereby incorporated by reference into this specification.

Referring again to FIG. 1, it will be seen that dump trailer 14 is connected to wings 16 and 18. These wings 16 and 18 may be raised and/or lowered by a hydraulic lift system comprised of hydraulic cylinder assemblies 20, 22 (see FIG. 1), and 24 (see FIG. 3).

The hydraulic lift system is preferably a two-stage hydraulic lift system. Thus, referring to FIG. 3, it will be seen that hydraulic cylinder assembly 22 is comprised of hydraulic cylinder 26 within which is disposed hydraulic cylinder 28 within which is disposed rod 30. Thus, the two stage hydraulic lift system operates by first extending cylinder 28 by means of hydraulic pressure, and thereafter extending rod 30 by means of hydraulic pressure.

Two stage hydraulic cylinder assemblies, and means for controlling them, are well known to those skilled in the art and are described, e.g., in 5,829,947 (two stage hydraulic lift cylinder), 5,649,424 (two stage pressure cylinder), 5,551,391 (control system for two stage hydraulic lift cylinder), 5,467,754, 5,341,837, 5,241,935, 4,852,464 (two stage telescoping hydraulic cylinder), 4,172,612 (two stage telescopic hydraulic cylinder), and the like. The entire disclosure of each of these United States patents is hereby incorporated by reference into this specification.

Thus, in the process of the invention, hydraulic cylinder 28 is first raised, and then rod 30 is then raised. Conversely, when hydraulic pressure has been removed, rod 30 is first retracted and lowered, and then hydraulic cylinder 28 is then retracted and lowered.

Referring again to FIG. 1, and in the preferred embodiment depicted therein, it will be seen that means for locking hydraulic cylinders 20, 22, et seq. are provided. In the preferred embodiment illustrated, manual hydraulic shut off valves 32 are provided, preferably one for each hydraulic cylinder assembly. These shut off valves 32, or similar structure, may be used to lock each such hydraulic cylinder assembly in place once it has reached the desired position.

Each of wings 16 and 18 preferably each have a width 34 of from about 4 to about 8 feet. It is preferred that the lengths of the wings be substantially equal to the lengths of the trailer 14 and/or the dump truck (not shown) to which the wings are connected.

FIG. 2 illustrates one preferred embodiment in which two winged tractor trailers 10 are used. In this embodiment, an excavator 51 equipped with a hydraulic hoe ram 52 is used to demolish the bridge deck 48. One may use other demolition means such as, e.g., those described in U.S. Pat. Nos. 5,014,381, 4,955,972, 4,641,581 (use of explosive charges), 4,633,975, and the like. The disclosure of each of these United States patents is hereby incorporated by reference into this specification.

In one embodiment, not shown, concrete slab saws are used to cut the bridge deck. These concrete slab saws are well known and are described, e.g., in U.S. Pat. Nos. 4,945,356, 4,938,201, 4,928,662, 4,889,675, 4,769,201, 4,310,198, and the like. The entire disclosure of each of these United States patents is hereby incorporated by reference into this specification.

In one aspect of this embodiment, the bridge deck 48 is cut into substantially rectangular slabs with a width of from about 5 to about 9 feet and a length of from about 6 to about 19 feet; it is preferred that each such slab be supported, at least in part, by one or more steel girders 50. Thereafter, each such slab is then hoisted off of the bridge by means of a hydraulic excavator 51 and/or a crane (not shown).

In another embodiment, the bridge deck 48 is cut into the aforementioned slabs by means of hydraulic excavator 51/hoe ram 52 (see FIG. 2) and thereafter, hoisted off the bridge, preferably by means of excavator 51. In this embodiment, it is preferred to cut the slab by means of the hoe ram 52, and thereafter support the cut slab with the hoe ram 52 while cutting the reinforcement bars on the left and right sides of the slab by means of a torch (such as an oxyacetylene torch), and thereafter fold the slab back towards the excavator 5 1, and thereafter cut the reinforcement bars on the back side of the slab.

Referring to FIG. 2, rear dump trailers 14 is completely disposed under the bridge deck 48. With wings 16 and 18 extended, the effective width 54 if presented to the deck is from about 9 to about 24 feet. Inasmuch as rear dump trailers 14 may be from about 16 to about 40 feet in length, the cross-sectional area provided by the winged receptacles to deck 48 is substantial. In general, an effective cross-sectional area of at least 500 square feet is provided to catch debris from deck 48. It is preferred that the effective cross-sectional area be from about 600 to about 800 square feet.

In one embodiment, not shown in FIG. 2, the wings 16 and 18 contact the bottom 46 of the bridge 56. In this embodiment, the receptacles formed by the bottom of the bridge 46, the upstanding wings 16 and 18, and the trailer 14, effectively protect vehicular traffic and/or persons near bridge from flying debris.

FIG. 4 is a perspective view of a dump trailer 14 equipped with wings 16 and 18 wherein the wings are supported by means of arms 60 and brackets 62.

FIG. 5 is a front view of a preferred bracket 62. Referring to FIG. 5, and in the preferred embodiment depicted, it will be seen that leg 64 is preferably longer than leg 66. The bracket 62 is preferably connected to wing 16 by means of pin 71. As will be apparent, the pin 70 allows the wing 16 to swivel upwardly and outwardly.

Thus, referring again to FIG. 4, wings 16 and 18 may be swiveled upwardly and outwardly in the direction of arrow 38 and, when it has reached its desired position, be held in place by stiff legs 60. One may use one-piece stiff legs 60 with a specified length. Alternatively, or additionally, one may use adjustable stiff legs with variable lengths.

As will be apparent, brackets 62 may be removably mounted on trailer 14, and/or they may be integrally and permanently affixed to the trailer by conventional means.

A Novel Overhang Bracket

FIG. 2 shows that, in the process depicted therein, in addition to using two winged tractor trailers 10 to catch failing debris, one may also use one or more overhang brackets 70 to catch debris in areas where the tractor-trailer assemblies 10 are not located. These overhang brackets 70 also serve to protect vehicular and pedestrian traffic under the bridge 56 while work is in progress.

Figure 9:
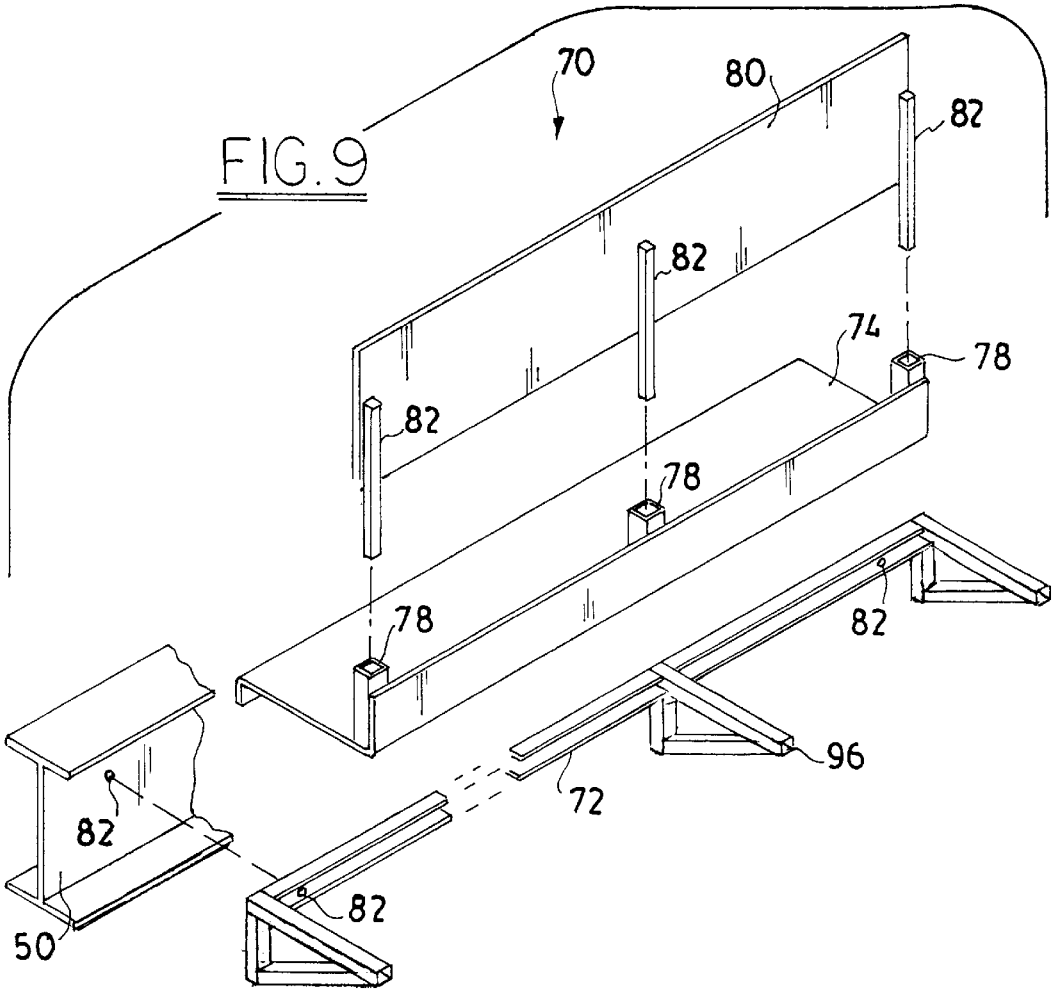
FIG. 9 is an exploded view of the overhang bracket assembly of FIG. 8.

One preferred embodiment of overhang bracket 70 is illustrated in FIG. 9. Referring to FIG. 9, it will be seen that bracket 70 is comprised of an bracket frame 72 and bracket deck 74 integrally connected to each other by conventional means such as, e.g., welding.

The bracket frame 72, in the embodiment depicted, is comprised of triangular braces 76. In the embodiment depicted, three such triangular braces are present. In general, it is preferred to use from about 2 to 4 such triangular braces.

The bracket deck 74 is preferably made from formed sheet metal to which are connected a multiplicity of post supports 78 preferably made from box tubing. Three such post supports are illustrated in FIG. 9, but from about 2 to about 4 such post supports 78 may be used.

As is illustrated in FIG. 9, removably connected to the bracket deck 74 is a splatter guard 80 which is comprised of a multiplicity of box tubing inserts 82 adapted to be received within post supports 78. The splatter guard 80 is preferably constructed from sheet metal or plywood.

Figure 10:
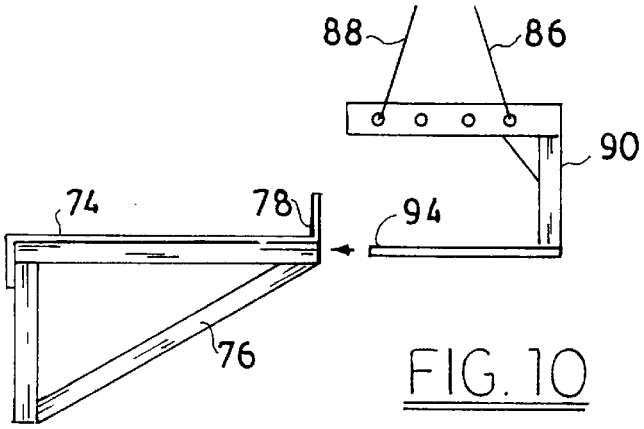
FIG. 10 is a schematic representation of disposing the overhang bracket assembler in a desired position.

Referring again to FIG. 9, it will be seen that the bracket frame 72/bracket deck 74 assembly, after the two pieces have been integrally connected to each other, may be joined to bridge girder 50 by means of connectors (not shown) disposed in orifices 82. In the embodiment depicted in FIG. 10, the orifices 82 (see FIG. 9) are lined up by means of crane or hydraulic excavator (not shown) from which cables 86 and 88 are suspended. The cables move an installation/removal bracket 90 into place so that, when moved in the direction of arrow 92 tube 94 may be inserted into orifice 96 of bracket frame 72 (see FIG. 9). After such insertion, the bracket frame 72/bracket deck 74 may be hoisted into a position appropriate to align orifices 82 (see FIG. 9).

A Preferred Process of the Invention

Figure 11:
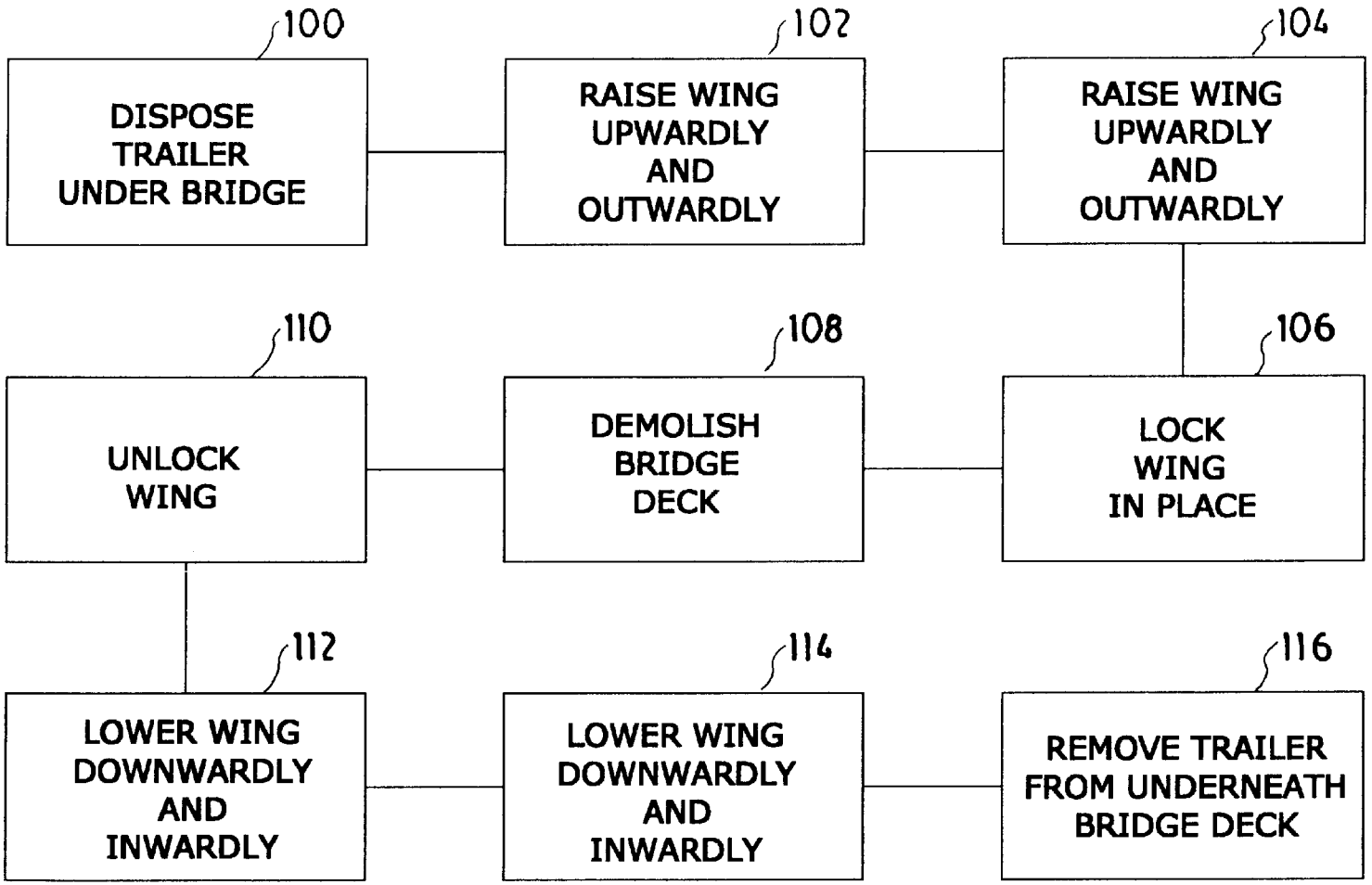
FIG. 11 is a flow diagram of one preferred process of the invention.

FIG. 11 illustrates one preferred process of the instant invention.

In step 100 of this process, one or more of tractor-trailers 10 is disposed under the bridge deck 48. In this step, it is preferred to so dispose the tractor-trailers 10 so that at least about 600 square feet of cross-sectional area is disposed above each such tractor trailer.

In one embodiment, not shown, the overhang bracket 70 is installed on the bridge deck prior to moving the tractor-trailer(s) 10 in place. In another embodiment, not shown, the overhang bracket 70 is installed on the bridge deck just after moving the tractor trailers 10 in place.

In step 102 of this process, wing 16 is initially raised upwardly and outwardly by means of a first hydraulic cylinder. Thereafter, in step 104 of this process, wing 16 is raised upwardly and outwardly by means of a rod.

Once the wing 16 has been raised to the desired position, it is preferably locked in place with shut off valves 32 in step 106. Thereafter, in step 108, the bridge deck 48 is demolished by conventional means.

It is preferred, after a section of bridge deck 48 has been demolished and/or after aL truck a receptacle has been completely filled, to lower the wing 16. Thus, in this preferred embodiment, in step 110, the wing 16 is preferably unlocked and, thereafter, in step 112, the wing 16 is moved downwardly and inwardly by retracting rod 30. Thereafter, in step 114 the wing 16 is further moved downwardly and inwardly by retracting hydraulic cylinder 28. Thereafter, in step 116, the tractor trailer 10 is driven away from the bride deck 48, preferably to a disposal area into shown) where the debris may be dumped or removed by other conventional means.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

We claim:

1. A process for demolishing a bridge deck by means of a truck assembly equipped with a receptacle comprised of a right side and a left side, a first wing rotatably connected to said right side of said receptacle, comprising the steps of:

(a) disposing said truck assembly beneath said bridge deck, (b) rotating said first wing upwardly and outwardly from said right side of said receptacle to a first position, (c) supporting said first wing in said first position by means of a support contiguous with said first wing, (d) demolishing said bridge deck and causing debris to fall therefrom, (d) receiving said debris from said bridge deck within said receptacle, (e) ceasing supporting said first wing in said first position and moving said first wing downwardly and inwardly towards said right side of said receptacle, (f) moving said truck assembly, and (g) removing said debris from said receptacle.

2. The process as recited in claim 1, wherein said truck assembly is comprised of a second wing rotatably connected to said left side of said receptacle.

3. The process as recited in claim 2, wherein said means of support is comprised of a first hydraulic cylinder assembly comprised of a first hydraulic cylinder, a second hydraulic cylinder disposed within said first hydraulic cylinder, and a first rod disposed within said second hydraulic cylinder.

4. The process as recited in claim 3, wherein said first hydraulic cylinder assembly is contiguous with said first wing.

5. The process as recited in claim 4, wherein said means of support is comprised of a second hydraulic cylinder assembly comprised of a third hydraulic cylinder, a fourth hydraulic cylinder disposed within said third hydraulic cylinder, and a second rod disposed within said fourth hydraulic cylinder.

6. The process as recited in claim 5, wherein said second hydraulic cylinder assembly is contiguous with said second wing.

7. The process as recited in claim 6, comprising the step of supporting said first wing by means of said first hydraulic cylinder assembly.

8. The process as recited in claim 7, comprising the step of supporting said second wing by means of said second hydraulic cylinder assembly.

9. The process as recited in claim 8, comprising the step of extending said second hydraulic cylinder away from said first hydraulic cylinder, thereby rotating said first wing upwardly and outwardly from said right side of said receptacle.

10. The process as recited in claim 9, comprising the step of extending said fourth hydraulic cylinder away from said third hydraulic cylinder, thereby rotating said second wing upwardly and outwardly from said left side of said receptacle.

11. The process as recited in claim 10, comprising the step of extending said first rod away from said second hydraulic cylinder, thereby rotating said first wing upwardly and outwardly from said right side of said receptacle.

12. The process as recited in claim 11, comprising the step of extending said second rod away from said fourth hydraulic cylinder, thereby rotating said second wing upwardly and outwardly from said left side of said receptacle.

13. The process as recited in claim 12, comprising the step of moving said first rod towards said second hydraulic cylinder, thereby rotating said first wing downwardly and inwardly towards said right side of said receptacle.

14. The process as recited in claim 13, comprising the step of moving said second rod towards said fourth hydraulic cylinder, thereby rotating said second wing downwardly and inwardly towards said left side of said receptacle.

15. The process as recited in claim 14, comprising the step of moving said second hydraulic cylinder towards said first hydraulic cylinder, thereby rotating said first wing downwardly and inwardly towards said right side of said receptacle.

16. The process as recited in claim 15, comprising the step of moving said fourth hydraulic cylinder towards said third hydraulic cylinder, thereby rotating said second wing downwardly and inwardly towards said left side of said receptacle.

* * * * *